US006364716B1

(12) United States Patent
Seo

(10) Patent No.: US 6,364,716 B1
(45) Date of Patent: Apr. 2, 2002

(54) ADAPTOR WITH ROTARY PLUG

(76) Inventor: Jeong-in Seo, 310, 111 Block, Hanshin At Cheolsan-dong, Kwangmyung city, Kyungki-do (KR)

( * ) Notice: Subject to any disclaimer, the term of this patent is extended or adjusted under 35 U.S.C. 154(b) by 0 days.

(21) Appl. No.: 09/828,975

(22) Filed: Apr. 10, 2001

(30) Foreign Application Priority Data

Feb. 6, 2001 (KR) ..... 01-5657

(51) Int. Cl.[7] ..... H01R 25/00; H01R 27/02
(52) U.S. Cl. ..... 439/640; 439/174
(58) Field of Search ..... 439/13, 131, 174, 439/173, 172, 171, 640, 446

(56) References Cited

U.S. PATENT DOCUMENTS 4,625,259 A * 11/1986 Krechmer et al. ..... 361/340
4,673,228 A * 6/1987 Ditzig ..... 439/13
4,743,999 A * 5/1988 Hames ..... 361/56
5,352,122 A * 10/1994 Speyer et al. ..... 439/13
5,692,921 A * 12/1997 Jennings ..... 439/173
5,738,540 A * 4/1998 Hetherington ..... 439/173
5,957,701 A * 9/1999 McMillin ..... 439/13
6,062,884 A * 5/2000 Messimer et al. ..... 439/172
6,089,921 A * 7/2000 Chou ..... 439/640
6,093,028 A * 7/2000 Yang ..... 439/13
6,118,643 A * 9/2000 Dyer et al. ..... 439/13

* cited by examiner

*Primary Examiner*—Brian Sircus
*Assistant Examiner*—Hae Moon Hyeon
(74) *Attorney, Agent, or Firm*—Lowe Hauptman Gilman & Berner, LLP

(57) ABSTRACT

Disclosed herewith is an adaptor with a rotary plug. The adaptor with a rotary plug includes a rotary plug having prongs, an adaptor housing holding the rotary plug, and electric adaptation parts being inserted into the adaptor housing. The adaptor further include a rotating means for rotating the rotary plug at 45° or 90° in each of right and left directions, and a restricting means for fixing the rotary plug at a position where the rotary plug is desirably rotated by means of the rotating means.

17 Claims, 5 Drawing Sheets

【FIG 1】
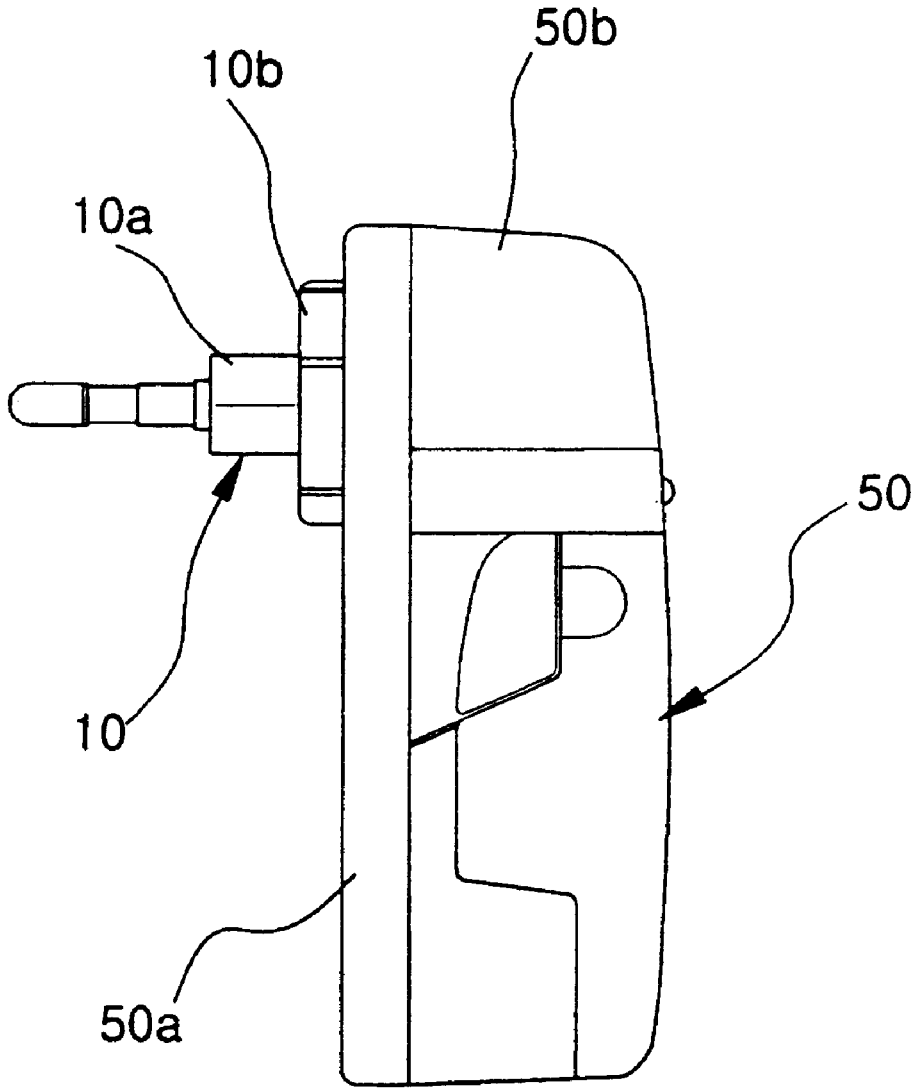

【FIG 2】
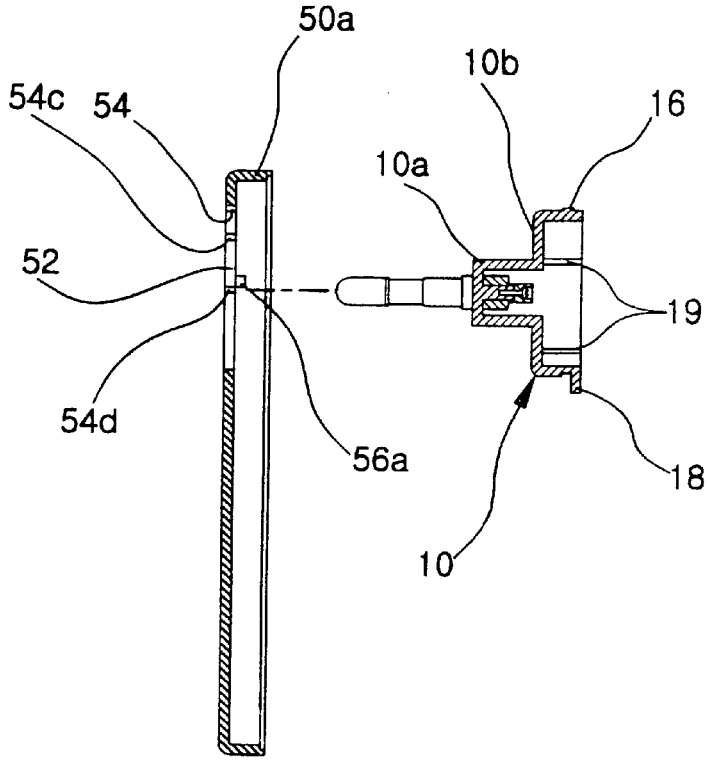
【FIG 3】
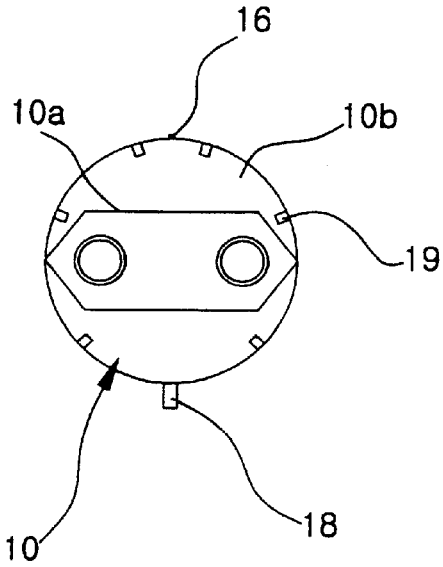

【FIG 4】
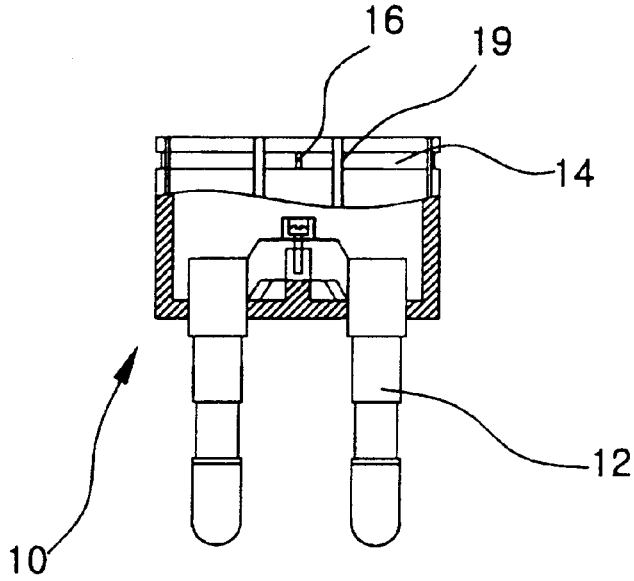
【FIG 5】
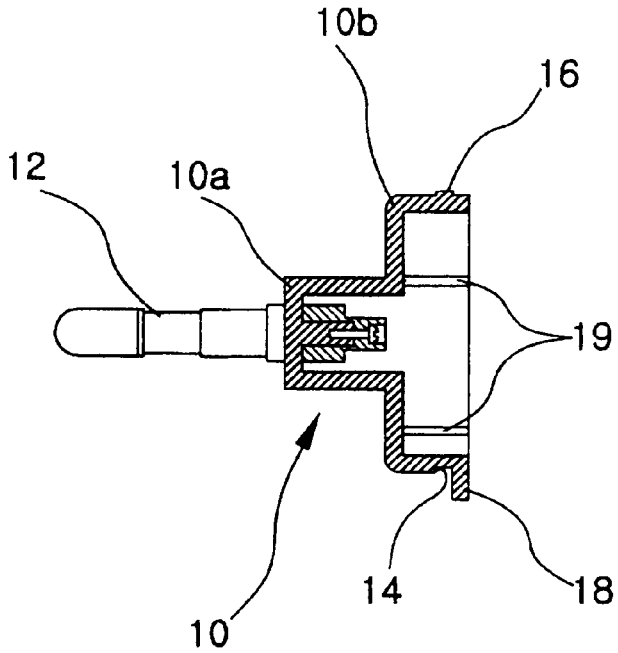

【FIG 6】
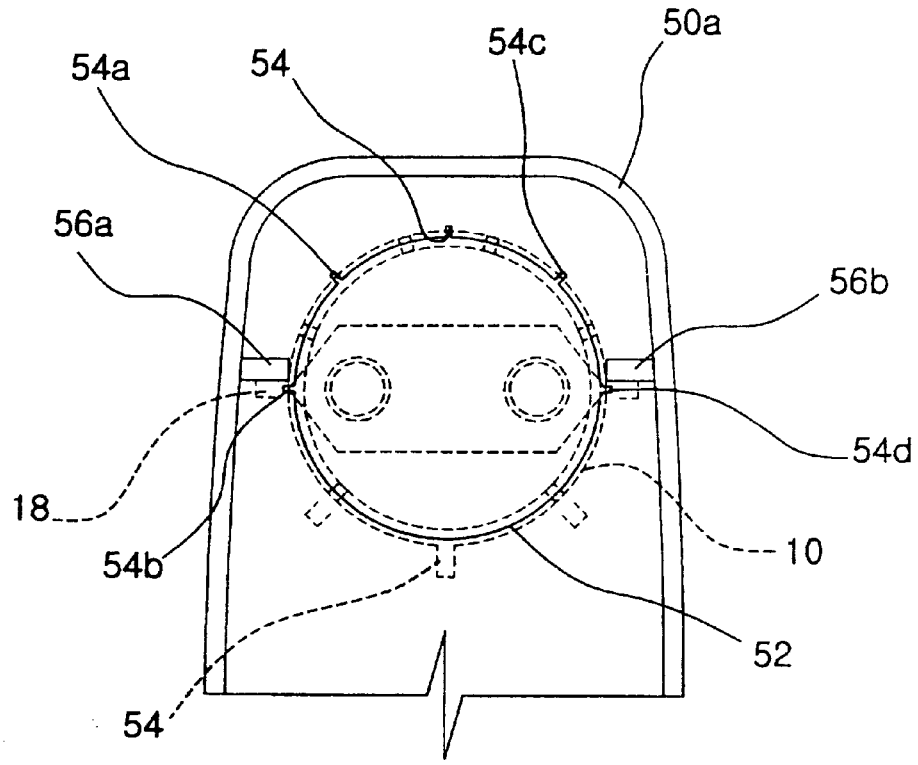
【FIG 7】
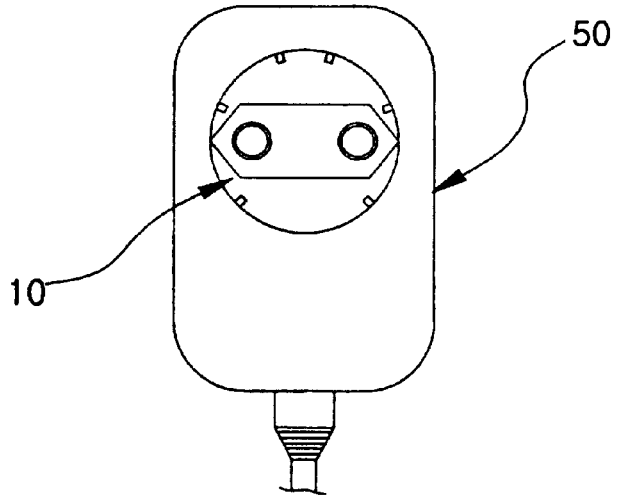

【FIG 8】
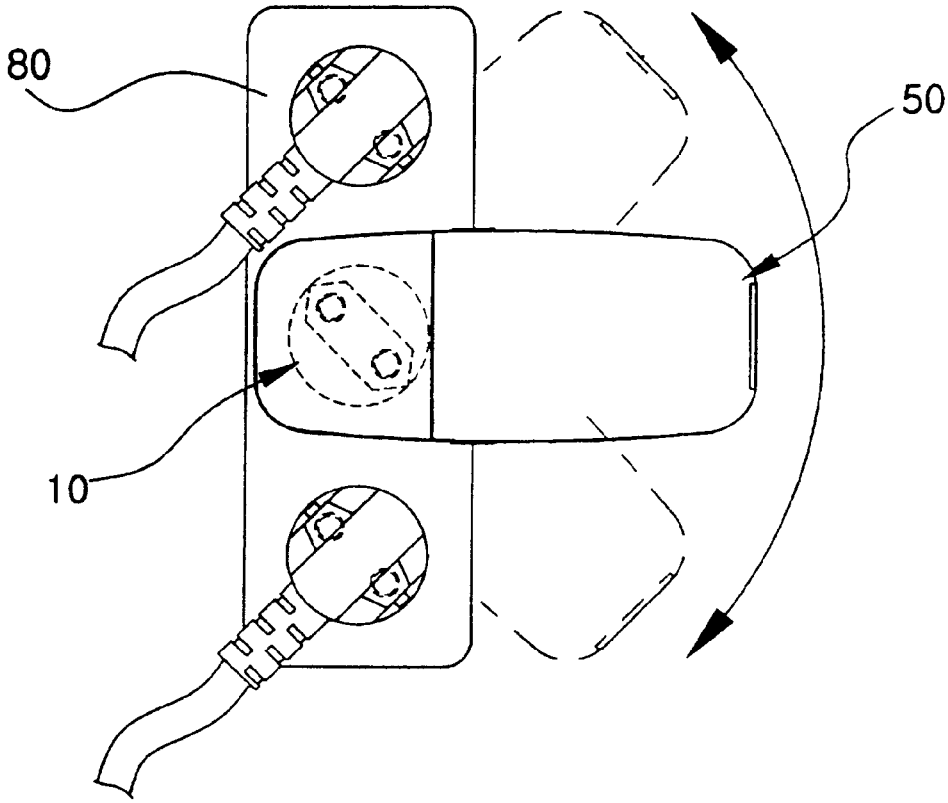

ADAPTOR WITH ROTARY PLUG

BACKGROUND OF THE INVENTION

1. Field of the Invention

The present invention relates generally to adaptors insertable to outlets, and more particularly to an adaptor provided with a rotary plug that can be rotated in right and left directions.

2. Description of the Prior Art

In general, outlets each have a plurality of sockets for accommodating a plurality of plugs therein.

The outlets each having a plurality of sockets are made in the forms of wall outlets or outlet strips.

In the meantime, with an increase in the use of electric appliances, a plurality of plugs are inserted into an outlet. According to the structures of such outlets and outlet strips, when a plurality of plugs are inserted into the outlets and outlet strips, other types of plugs except for straight types of plugs interfere with one another.

As a result, a plurality of plugs are rarely inserted into the outlet except when the plugs are inserted into the outlet in well-controlled directions.

In particular, adaptors, which are used as adaptors for apparatuses such as down transformers and rectifiers and chargers for charging batteries, have relatively great widths and lengths, so the degree of interference is serious.

In order to overcome the above problems, a variety of proposals are presented.

One of the proposals is an outlet strip in which its sockets are designed to be inclined at 45° degrees so as to prevent interference with neighboring plugs.

However, even in such a case, for adaptors and chargers having relatively great sizes, interference with neighboring plugs is unavoidable.

Korean Unexamined Pat. Pub. No. 97-54949 discloses an outlet, in which a plurality of sockets are provided to accommodate a plurality of plugs, and its center socket portion is designed to be rotatable so as to prevent the interference of neighboring plugs.

However, in accordance with the above patent publication, the socket portion should be rotated while maintaining electric connection with the other portions, so the structure of its terminal is complicated and connection failure easily occurs.

SUMMARY OF THE INVENTION

Accordingly, the present invention has been made keeping in mind the above problems occurring in the prior art, and an object of the present invention is to provide an adaptor with a rotary plug, which is capable of allowing its plug to be rotated in right and left directions relative to its adaptor housing so as to prevent the adaptor from interfering with one or more neighboring plugs.

In addition, the present invention provides an adaptor with a rotary plug, in which its plug is electrically connected to electric adaptation parts in a sample structure, thereby reducing connection failures and allowing long lasting use.

The present invention provides an adaptor with a rotary plug, which is capable of stopping the rotary plug from rotating from a fixed position so as to prevent it from being removed from the position.

In order to accomplish the above object, the present invention provides a adaptor having a rotary plug having prongs, an adaptor housing holding the rotary plug, and electric adaptation parts being inserted into the adaptor housing, the adaptor comprising: a rotating means for rotating the rotary plug at 45° or 90° in each of right and left directions; and a restricting means for fixing the rotary plug at a position where the rotary plug is desirably rotated by means of the rotating means.

The rotating means may comprise a circumferential groove formed along the outer surface of the rotary plug, a plurality of slits axially and regularly formed in the sidewall of the rotary plug, and an opening that is formed on the adaptor housing and into which the rotary plug is rotatably fitted; and the restricting means may comprise a projection formed at a position of the outer surface of the rotary plug, a restricting projection formed at the position opposite to the position of the projection, a central groove formed on the circumferential edge of the opening of the adaptor housing, side grooves formed on the circumferential edge of the opening of the adaptor housing with each pair of side grooves formed on each side of the groove at an interval of 45°, and projections radially outwardly extended from the outer portion of the adaptor housing.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a side elevation showing an adaptor with a plug, which is used as a charger, in accordance with the present invention;

FIG. 2 is an exploded sectional view showing the principal parts of the adaptor of FIG. 1;

FIG. 3 is a front view of the plug of FIG. 2;

FIG. 4 is a horizontal cross section of FIG. 3;

FIG. 5 is a vertical cross section of FIG. 3;

FIG. 6 is a view showing the operation of the adaptor;

FIG. 7 is a view showing an adaptor with a plug that is used as a power adaptor; and FIG. 8 is a plan view showing the use of the adaptor.

DESCRIPTION OF THE PREFERRED EMBODIMENTS

Reference now should be made to the drawings, in which the same reference numerals are used throughout the different drawings to designate the same or similar components.

FIG. 1 is a side elevation showing an adaptor with a rotary plug that can be used as a charger.

The adaptor with a rotary plug is basically comprised of a rotary plug 10 and an adaptor housing 50.

The rotary plug 10 is comprised of a plug housing and two prongs 12. The plug housing is comprised of a protruding portion 10*a* and a rotary portion 10*b*. The rotary portion 10*b* is shaped in the form of a hollow cylinder. The rotary portion 10*b* is provided with a groove 14 circumferentially formed along its outer surface, a projection 16 formed at a position of its outer surface, a retaining projection 18 formed at the position opposite to the position of the projection 16, and a plurality of slits 19 axially and regularly formed therein.

The adaptor housing 50 is comprised of lower adaptor housing 50*a* and upper adaptor housing 50*b*. The lower adaptor housing 50*a* is provided with an opening 52 into which the rotary plug 10 is rotatably fitted, a central groove 54 formed on a position on the circumferential edge of the opening 52, side grooves 54*a*, 54*b*, 54*c* and 54*d* formed on the circumferential edge with each pair of side grooves 54*a* and 54*b*, or 54*c* and 54*d* formed on each side of the groove 54 at an interval of 45°, and restricting projections 56*a* and 56*b* radially outwardly extended from the outer portion of the adaptor housing 50.

The adaptor housing 50 is provided with an inner cavity in which electric adaptation parts are accommodated.

Reference numeral 80 designates an outlet.

The operation of the adaptor with a rotary plug in accordance with the present invention is described hereinafter.

While the rotary plug 10 is fitted into the opening 52 of the adaptor housing 50, the rotary plug 10 is elastically retracted with the aid of the slits 19 formed in the rotary portion 10*b* of the plug housing.

In an initial state, the groove 54 is engaged with the projection 16.

The width of the groove 14 formed on the outer surface of the rotary portion 10*b* is the same as the thickness of the lower adaptor housing 50*a*, so the circular groove 14 formed on the rotary plug 10 is rotatably engaged with the opening 52 of the Lower adaptor housing 50*a*.

When a user wants to prevent the adaptor with a rotary plug 10 from interfering with one or more neighboring plugs, the user rotates the adaptor housing 50 in one of right and left directions while holding it. At this time, the adaptor housing 50 is rotated around the rotary plug 10 that is inserted into and held by the outlet 80.

For example, when the adaptor housing 50 is rotated in a left direction, the projection 16 formed on the rotary plug 10 is removed from the groove 54 formed on the adaptor housing 50, and may be moved till it is engaged with one of the grooves 54*a* and 54*b*. While the projection 16 is removed from and engaged with the groove 54, 54*a* or 54*b*, the rotary portion 10*b* is elastically deformed with the aid of slits 19 formed in the rotary portion 10*b*.

The angle of rotation in each of right and left directions is restricted to 90° by means of the restricting projections 56*a* and 56*b*. If the rotation of more than 90° is necessary in each direction, the adaptor of the present invention can be inserted in the opposite side, which allows the rotation of more than 90° to be actually obtained.

As a result, when a user employs the adaptor with a rotary plug of the present invention, he can insert a plurality of plugs into a wall outlet or outlet strip without interference with neighboring plugs.

Meanwhile, since the angle of rotation in each of right and left directions is restricted to 90°, the electric wire connected to the adaptor of the present invention is not entangled, but is bent, thereby eliminating the occurrence of the problems regarding entanglement.

As illustrated in FIG. 7, the adaptor with a rotary plug in accordance with the present invention can be applied to a general adaptor used as a converter.

As described above, the present invention provides an adaptor with a rotary plug, which is capable of preventing the adaptor from interfering with one or more neighboring plugs because the adaptor can be rotated in right and left directions, which is capable of reducing connection failures and allowing long lasting use because its plug is electrically connected to its adaptor housing in a simple structure, and which is capable of preventing the rotary plug from being undesirably removed from its fixed position because the adaptor housing is secured to the position by a projection-groove mechanism of the adaptor.

Additionally, the present invention can be applied to not only a small sized adaptor and but also a plug itself.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electrical device, comprising:

a first member formed as a body having a circumferential groove formed on an outer circumferential surface thereof;

a second member formed as a housing having an opening on an outer surface thereof, the opening being sized to receive the first member therein with an inner edge of the opening extending into the circumferential groove of the first member, whereby the first and second members are rotatably engaged with each other;

a retaining mechanism for fixing the first and second members at at least one relative position when the second member is rotate about the first member; and at least one prong formed on one of the first and second members for electrical connection with external electrical circuitry.

2. The electrical device of claim 1, further comprising internal electrical circuitry placed in the other of the first and second members.

3. The electrical device of claim 2, wherein the at least one prong is formed on the first member which is configured as an electrical plug, and the internal electrical circuitry includes an adaptation circuit placed in the second member which is configured as a power adapter.

4. The electrical device of claim 1, wherein the body is resiliently inwardly deformable.

5. The electrical device of claim 4, wherein the first member includes a plurality of slits formed on the outer circumferential surface of the body.

6. The electrical device of claim 1, wherein the retaining mechanism is configured to fixing the first and second members at a plurality of regularly angularly spaced relative positions.

7. The electrical device of claim 1, wherein the retaining mechanism includes at least one notch and at least one projection formed in either the first and second members, respectively, or the second and first members, respectively, whereby the first and second members are fixed at the at least one relative position when the at least one projection is releasably received in the at least one notch.

8. The electrical device of claim 7, wherein the at least one notch is formed in the inner edge of the opening and the at least one projection projects from the outer circumferential surface of the body radially outwardly.

9. The electrical device of claim 8, wherein the at least one notch includes a plurality of notches formed in the inner edge of the opening, the notches are regularly angularly spaced.

10. The electrical device of claim 9, wherein the notches are angularly spaced by about 45°.

11. The electrical device of claim 1, wherein the retaining mechanism includes a first stop formed on the outer circumferential surface of the first member, and a pair of second stops formed on the outer surface of the second member for abutting the first stop, thereby defining angular limits within which the second member can be rotated about the first member.

12. An electrical adapter, comprising:

a housing having an opening on an outer surface thereof;

internal electrical circuitry placed in the housing;

a plug having a circumferential groove formed on an outer circumferential surface thereof, said plug being resiliently inwardly deformable and adapted to be rotatably fitted in the opening of the housing at least one prong formed on the plug and electrically connected to the internal electrical circuitry; and a retaining mechanism for fixing the plug and the housing at a plurality of angularly spaced relative positions when the housing is rotated about the plug, the retaining mechanism including a plurality of notches formed in an inner edge of the opening and corresponding to the relative positions of the plug and the housing, and a projection radially outwardly extending from the outer circumferential surface of the plug and adapted to be releasably receive in the notches, whereby the plug and housing are fixed at the relative positions when the projection is releasably received in the corresponding notches.

13. The electrical device of claim 12, wherein the internal electrical circuitry includes an adaptation circuit for configuring the electrical device to function as a power adapter.

14. The electrical device of claim 12, wherein the plug includes a plurality of slits formed on the outer circumferential surface thereof.

15. The electrical device of claim 12, wherein the notches are regularly angularly spaced.

16. The electrical device of claim 15, wherein the notches are angularly spaced by about 45°.

17. The electrical device of claim 12, further comprising a first stop formed on the outer circumferential surface of the plug, and a pair of second stops formed on the outer surface of the housing for abutting the first stop, thereby defining angular limits within which the housing can be rotated about the plug.

* * * * *